United States Patent [19]

Baumberg

[11] Patent Number: 4,671,741

[45] Date of Patent: Jun. 9, 1987

[54] PIPE FOR ELEVATING LIQUIDS THROUGH SUCCESSIVELY ARRANGED ACCUMULATING AND COMMUNICATING PORTIONS, AND DEVICE PROVIDED THEREWITH

[76] Inventor: Iosif Baumberg, 69 Bay 29 St., Brooklyn, N.Y. 11214

[21] Appl. No.: 874,079

[22] Filed: Jun. 13, 1986

[51] Int. Cl.[4] ..... F04B 23/14; F04F 1/18

[52] U.S. Cl. ..... 417/87; 417/90; 417/108

[58] Field of Search ..... 417/54, 76, 85–87, 417/90, 108, 109, 121

[56] References Cited

U.S. PATENT DOCUMENTS

| | | | |
|---|---|---|---|
| 368,691 | 8/1887 | See | 417/87 |
| 1,154,745 | 9/1915 | Browne | 417/108 X |
| 1,339,137 | 5/1920 | Rogers | 417/108 |
| 1,447,052 | 2/1923 | Sweetman | 417/54 |
| 1,741,571 | 12/1929 | Ives | 417/108 |
| 1,811,295 | 6/1931 | Blow | 417/108 |
| 2,461,032 | 2/1949 | Bush | 417/108 |

FOREIGN PATENT DOCUMENTS

| | | | |
|---|---|---|---|
| 95839 | 1/1898 | Fed. Rep. of Germany | 417/108 |
| 371487 | 3/1923 | Fed. Rep. of Germany | 417/108 |
| 864203 | 1/1953 | Fed. Rep. of Germany | 417/151 |
| 441332 | 5/1912 | France | 417/85 |
| 461374 | 10/1913 | France | 417/121 |
| 595674 | 7/1925 | France | 417/90 |
| 7240 | of 1892 | United Kingdom | 417/108 |

*Primary Examiner*—Carlton R. Croyle
*Assistant Examiner*—Paul F. Neils
*Attorney, Agent, or Firm*—Ilya Zborovsky

[57] ABSTRACT

A device for elevating liquids in which liquid is raised in a pipe under the action of a pressure difference which is smaller than a pressure difference of a solid liquid column having a height equal to a height of elevation.

14 Claims, 9 Drawing Figures

PIPE FOR ELEVATING LIQUIDS THROUGH SUCCESSIVELY ARRANGED ACCUMULATING AND COMMUNICATING PORTIONS, AND DEVICE PROVIDED THEREWITH

BACKGROUND OF THE INVENTION

The present invention relates to devices for elevating liquids, in which liquid elevates in a pipe under the action of a pressure difference which is smaller than a pressure difference of a solid liquid column with a height equal to a height of elevation.

Devices of the above mentioned type (air-lifts) are known in the art. In the known devices a part of the liquid column in the pipe is replaced by gas gaps or plugs, preferably air gaps or plugs (bubbles). Such devices are disclosed in U.S. Pat. Nos. 532,699; 556,436; 566, 987; 580, 540; 597,023; 1, 154,745; 1, 343, 963; 1,741, 571; 4, 513, 887; 4, 519,749, British Pat. No. 2, 097, 485 and my U.S. Patent Application Ser. Nos. 700, 908 and 700, 961. The disadvantage of the above devices is that the pipe cannot exceed a certain diameter which is required for forming of stable liquid portions separated by gas portions, for a given material of the pipe and at a given temperature. Meniscuses which are formed at the upper and lower border of each liquid portion must not be destroyed under the action of weight of the liquid portions and loads caused by their movement along the pipe. For example, for providing stable water portions separated by gas portions in a glass pipe at the temperature of 20° C., the inner diameter of the pipe must be lower than 4 mm, and for gasoline—not more than 3 mm.

U.S. Pat. No. 4,527,956 discloses a pipe for elevating liquids, which can have a greater diameter. However, it has a complicated construction, is expensive, has a great weight, offers high resistance to liquid flow, and requires high maintenance expenses.

SUMMARY OF THE INVENTION

Accordingly, it is an object of the present invention to provide a pipe and a device therewith for elevating liquids, which avoid the disadvantages of the prior art.

In keeping with these objects and with others which will become apparent hereinafter, one feature of the present invention resides, briefly stated in a pipe which has a plurality of substantially horizontal liquid accumulating portions located vertically adjacent to one another, a plurality of pairs of substantially vertical communicating portions each communicating two adjacent accumulating portions with one another, and a plurality of self-emptying vessel each located in the respective liquid accumulating portion so that a lower end of one communicating portion of each pair opens to the self-emptying vessel located in the respective liquid accumulating portion.

A device in accordance with the invention includes the above pipe, a liquid supplying element connected with its lower end, and a liquid withdrawing element connected with its upper end for respectively supplying and withdrawing the liquid.

The novel features of the present invention are set forth in particular in the appended claims. The invention itself, however, will be best understood from the following description of preferred embodiments which is accompanied by the following drawings.

DESCRIPTION OF PREFERRED EMBODIMENTS

Figure 1:
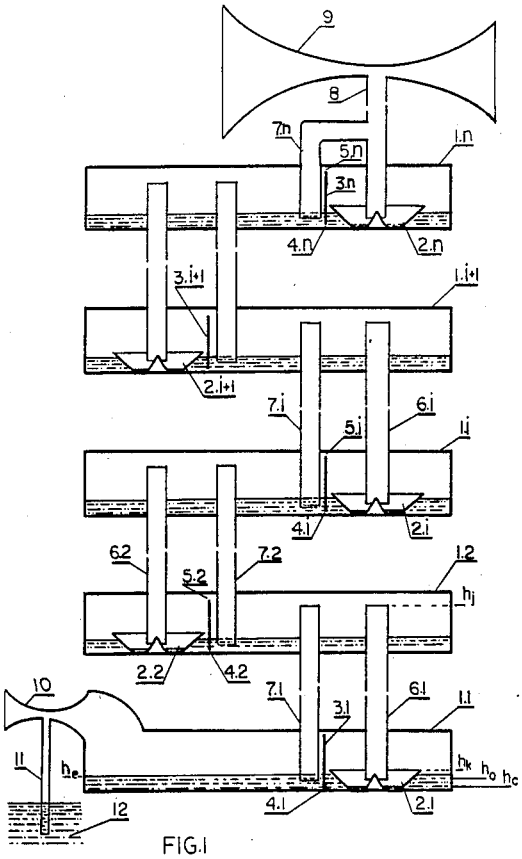
FIGS. 1–5 are views showing a pipe and device for elevating liquids, in accordance with the invention, at different stages of liquid elevation.

A device for elevating liquids includes a pipe which has $n>1$ liquid accumulating containers **1.1–1.*n* located vertically adjacent to one another. Each container is provided substantially on its bottom with a self-emptying vessel 2.1–2.*n***. The vessel is formed as a W-shaped wall which is a body of revolution. Each outer leg of the wall is connected with the adjacent inner leg by a smooth curved bottom, and the legs are inclined to a horizontal plane substantially at 45°.

Each liquid accumulating container is subdivided by a partition **3.1–3.*n* into an inlet part of a greater volume and an outlet part of a smaller volume. The self-emptying vessel is located in the outlet part. The inlet part and the outlet part of each liquid accumulating container communicate with one another through a lower gap 4.1–4.*n* under each partition and an upper gap 5.1–5.*n*** over each partition.

Each lower liquid accumulating container **2.*i* communicates with a closest upper liquid accumulating container 2*i*+1 by a pair of communicating pipe portions 6.1–6.*n* and 7.1–7.*n*. One communicating pipe portion of each pair 6.*i* opens with its lower end toward the respective vessel 2.*i* and is coaxial therewith. The upper lower end of the communicating pipe portion 6.*i* extends into the inlet part of the adjacent upper accumulating container 1.*i*+1. The second communicating pipe portion 7.*i* has the same length as the first communicating pipe portion 7.*i* and also extends into the inlet part of the adjacent upper accumulating container 1.*i*+1**.

Both communicating pipe portions **6.*i* and 7.*i* are located at the same height. Their open lower ends are spaced from the bottom of the accumulating container 1.*i* at a distance $h_o$, while their open upper ends are spaced from the bottom of the adjacent upper accumulating container 1.*i*+1 at a distance $h_j$, and $h_j>h_o$. The pipe portions 6.*n* and 7.*n* of the uppermost container 1.n are united by a pipe portion 8 whose upper end is connected with an upper jet pump 9 and more particularly with its portion which connects the diffusers of the jet pump and extends substantially horizontally. The inlet part of the lowermost container 1.1 is connected with an outlet diffuser of a lower jet pump 10 which has between its diffusers a substantially horizontal portion connected with a supply pipe portion 11. The latter communicates with a liquid source 12. The height of each vessel 2.i**$h_k>h_o$.

The above described device operates in the following manner.

Figure 2:
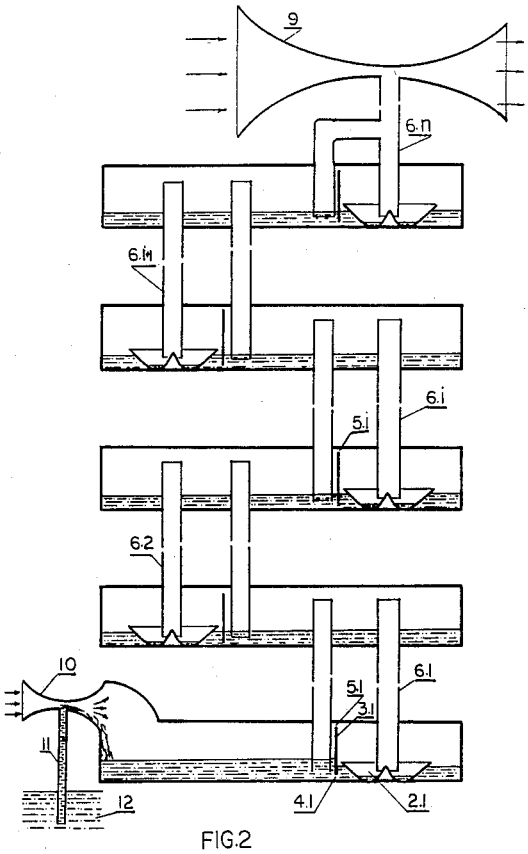
Figure 3:
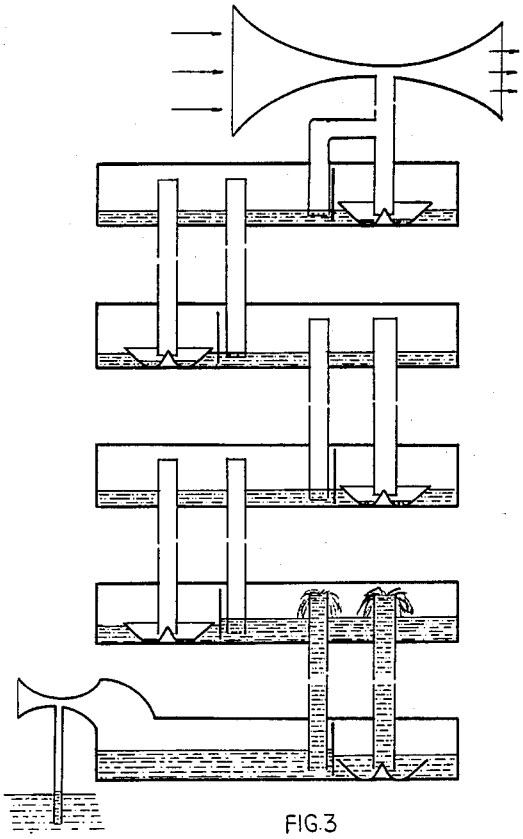
Figure 4:
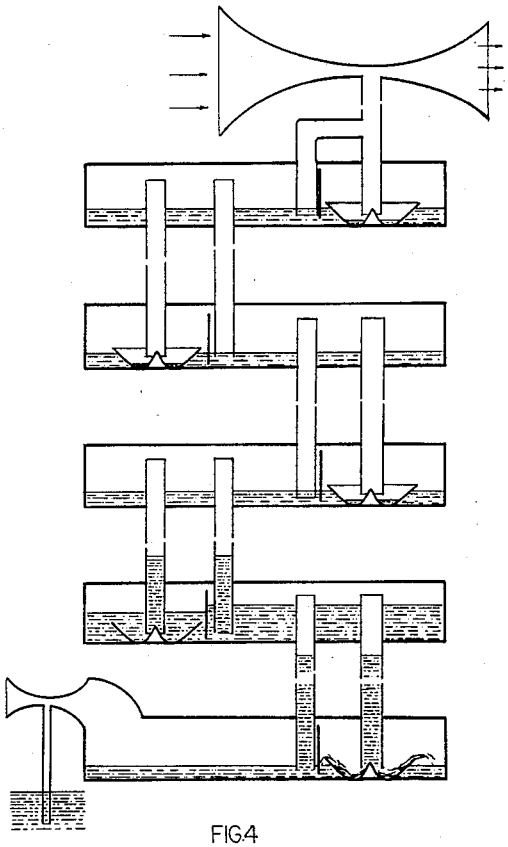
Figure 5:
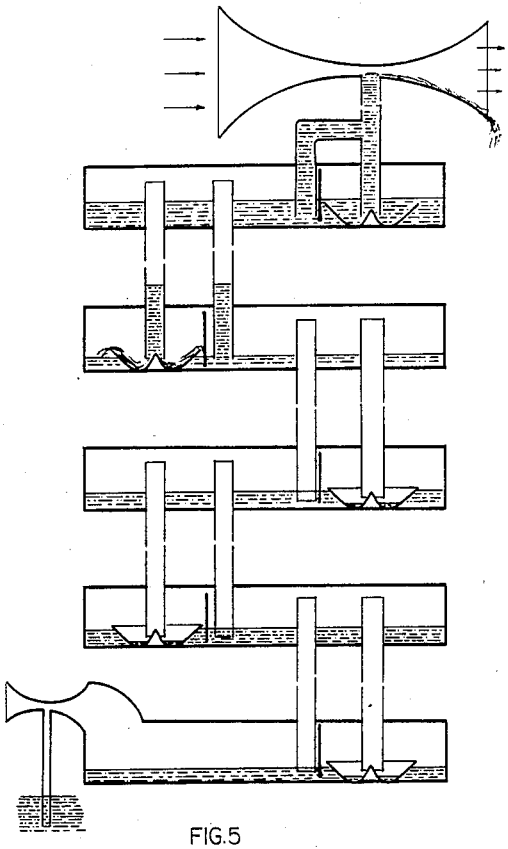

FIG. 1 shows an initial position in which the supply pipe portion 11 is immersed with its lower end into the liquid source 12, the liquid in the self-emptying vessels **2.*i* reaches the level $h_c>h_o$, the liquid in the containers 1.*i* reaches the level $h_e>h_k$. Under the action of air flow, caused for example by wind, which passes through the upper jet pump 9, a pressure which is lower than the atmospheric pressure is produced in the device and air is aspirated from the surrounding through the lower jet pump 10. As a result of this , the pressure in the lower jet pump decreases, the liquid is elevated through the pipe portion 11 and supplied into the inlet part of the lowermost container 1.1 (FIG. 2). Through the lower gap 4.1 under the partition 3.1 the liquid passes from the inlet part into the outlet part. The liquid level in in the outlet part is equalized with the liquid level in the inlet part with a certain delay. This is needed for accumulating in the container 1.1 the required quantity of liquid up to the time moment when the liquid will raise above the level $h_k$, flow into the vessel 2.1 and close the lower end of the pipe portion 6.1. After the liquid in the outlet part of the container reaches the level $h_3 \geqq h_k$, the liquid will start filling the vessel 2.1. When the liquid level in the vessel 2.1 reaches the level $h_4 \geqq h_o$, the liquid will close the lower open ends of the pipe portions 6.1 and 7.1, aspiration of air through the lower jet pump will stop, and flow of liquid through the supply pipe 11 will stop as well. Thereby, formation of a liquid portion in the container 1.1 for elevating the same upwardly is completed (FIG. 3). Under the action of further pressure decrease in the device, produced by the upper jet pump 9, the liquid is sucked from the container 1.1 through the pipe portions 6.1 and 7.1 into the second container 1.2. This process of flowing the liquid from the container i into the container i'continues until the liquid level in the container i will lower to $h_o$. Under the action of increase of the pressure difference between the containers i and i+1, air passes through the gaps between the liquid columns in the pipe portions 6.*i* and 7.*i* in the beginning in the form of separate bubbles and then as an uninterrupted flow, into the container i+1. The air pressure between the containers i and i+1 equalizes, and remaining part of liquid from the pipe portions 6.*i* and 7.*i* flow downwardly. As a result of the speed produced in the pipe portion 6.*i* under the action of gravity acceleration, the liquid is reflected from the central wall portions of the vessel 2.*i*, flows over the outer wall portions and then outwardly of the vessel 2.*i* (FIG. 4). Thus the pipe portion 6.*i* and the vessel 2.*i* are released from liquid. The container i returns to its initial position. When the liquid portion supplied to the lowermost container i.1 is successively passed from the container i to the container i+1 and finally is discharged through the outlet diffuser of the jet pump 9 (FIG.5), the device returns to its initial position shown in FIG. 1**, and a new cycle starts.

Figure 6:
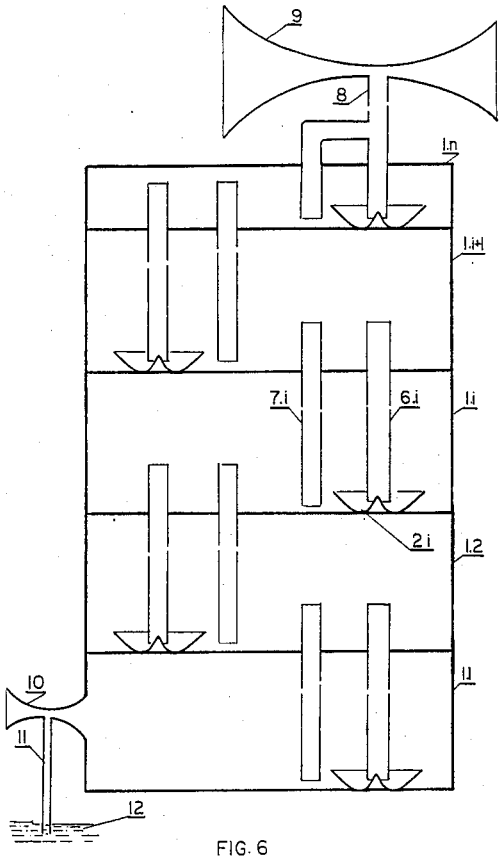
FIG. 6 is a view showing another embodiment of the invention.

FIG. 6 shows the pipe in accordance with another embodiment , in which the pipe has an uninterrupted wall with the above described liquid accumulating containers and pairs of connecting pipe portions. The adjacent containers are separated from one another by a single horizontal partition.

Figure 7:
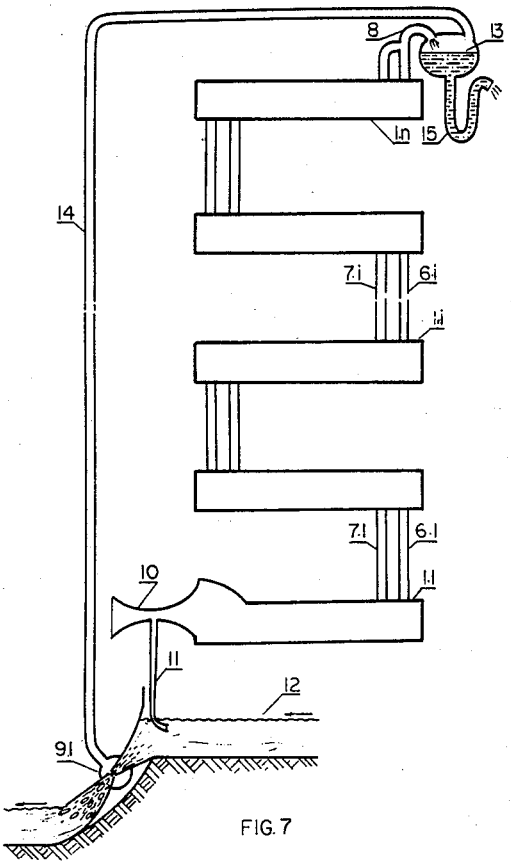
FIG. 7 is a view showing a further embodiment of the invention.

FIG. 7 shows a further embodiment of the invention. Here the upper end of the pipe is connected with a liquid jet pump 9.1 by a pipe portion 14 so that the liquid passing through the jet pump 9.1 produced the required decreased pressure in the device. The liquid withdrawn from the upper end of the pipe flows into a hermetic container 13 which is directly connected with the jet pump 9.1 and has a curved outlet pipe portion 15. A faucet can be provided for liquid discharge, instead of the curved portion 15. The liquid level difference between the outlet of the pipe portion 15 and in the container 13 is greater than the height of the pipe portions **6.*i* and 7.*i*, and under the action of the decreased pressure produced by the jet pump 9.1 the liquid will be sucked from one container 1.*i* into the other container 1.*i*+1** as described hereinabove.

Figure 8:
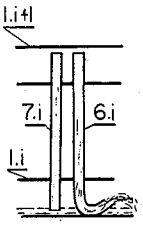
FIGS. 8 and 9 show two further embodiments of the invention.

FIG. 8 shows another embodiment of the vessel 2. Instead of the vessel 2, a curved pipe portion can be provided at the bottom of the pipe **6.*i* and made of one piece with the latter. It performs the same functions of allowing emptying of the pipe 6.*i***.

Figure 9:
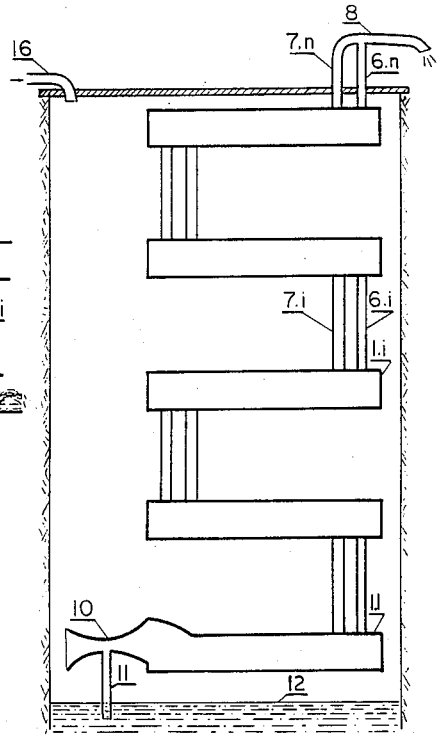

Finally, FIG. 9 shows that a pressure differential can be produced without the upper jet pump, for example by supplying gas through the pipe 16 into a well and the like, in which the inventive device is arranged.

The invention is not limited to the details shown since various modifications and and structural changes are possible without departing from the spirit of the invention.

It should be stated that the diameter of the pipes 6 and 7 must be not smaller than the diameter at which stable liquid columns separated by gas gaps will be formed. The principle of operation of the inventive pipe and device is based on that the pipe 6 is empitied and the liquid is discharged from it(because of the emptying member) , so that gas passes through the pipe 6 for producing the pumping -up(lifting) force. In contrast, the pipe 7 always retains liquid and is blocked from below so that the liquid can be pumped upwardly. The volume of the pipes 6 and 7 does not exceed the volume in the container which is limited from below by a horizontal plane extending through the lower edge of the pipes 6 and 7, and from above by a horizontal plane extending through the upper edge of the vessel 2 of the lower curved portion of the pipe 6.

What is desired to be protected by Letters Patent is set forth in the appended claims:

1. A pipe for elevating liquids, comprising a plurality of substantially horizontal liquid accumulating portions located vertically adjacent to one another and each having an upper region and a lower region as well as an upper end and a lower end;

a plurality of pairs of substantially vertical communicating portions arranged so that each pair of said communicating portions communicate two adjacent ones of said liquid accumulating portions with one another, each pair of said communicating portions being formed as two pipe portions having substantially equal heights and open lower and open upper ends, said pipe portions which form said communicating portions of each pair being arranged so that their lower ends are located in said lower region and close to said lower end of a lower one of said liquid accumulating portions and their upper ends are located in said upper region and close to said upper end of an immediately next upper one of said liquid accumulating portions;

a plurality of emptying members each located in a respective one of said liquid accumulating portions so that one communicating portion of each pair is located with its lower end immediately above and opens to said emptying member located in a respective one of said liquid accumulating portions and empties into the same;

means forming an air inlet, a liquid inlet, and an outlet; and pump means for producing a pressure for elevating a liquid successiviely through said communicating portions and liquid accumulating portions.

2. A pipe as defined in claim 1, wherein each of said liquid accumulating portions is formed as a container portion, each of said communicating portions being formed as a pipe portion.

3. A pipe as defined in claim 1, wherein said emptying member has a wall which is formed as a W-shaped body of revolution and is open upwardly toward said lower end of said one communicating portion of each pair of said communicating portions.

4. A pipe as defined in claim 1, wherein said wall of each of said emptying members has a central upwardly convex section which is coaxial with said one communicating portion of a respective of said pairs of communicating portions 5. A pipe as defined in claim 1, wherein each of said liquid accumulating portions has as inlet part and an outlet part, said communicating portions being arranged so that each pair of said communicating portions communicate a lower one of said liquid accumulating portions with said inlet part of an immediately next upper one of said liquid communicating portions.

6. A pipe as defined in claim 5, wherein said inlet part of each of said liquid accumulating portion has a greater volume than said outlet part of the same liquid accumulating portion.

7. A device for elevating liquid, comprising a pipe having a plurality of substantially horizontal liquid accumulating portions vertically spaced from one another and each having an upper region and a lower region as well as an upper end and a lower end , a plurality of pairs of substantially vertical communicating portions arranged so that each pair of said communicating portions communicate two adjacent ones of said liquid accumulating portions with one another and formed as two pipe portions having substantially equal heights and open lower and open upper ends and located so that said lower ends of each pair of pipe portions are located in said lower region and close to said lower end of a lower one of said liquid accumulating portions while said upper ends of each pair of pipe portions are located in said upper region and close to said upper end of an immediately next upper one of said liquid accumulating portions , and a plurality of emptying members each located in a respective one of said liquid accumulating portions so that one communicating portion of each pair is located with its lower end immediately above and opens to said emptying member located in a respective one of said liquid accumulating portions;

a first pump means for supplying a liquid and air into said pipe from below the latter; and a second pump means for withdrawing a liquid from said pipe from above the latter.

8. A device as defined in claim 7, wherein said pipe has an upper end section and a lower end section, each of said liquid accumulating portions having an inlet part and an outlet parts, said liquid accumulating portions having a lowermost liquid accumulating portion located in said lower end section of said pipe and communicating with said liquid supplying pump means, said pairs of said communicating portions including an uppermost pair of said communicating portions located in said upper end section of said pipe and communicating with said liquid withdrawing pump means.

9. A device as defined in claim 7, each of said first and second pump means includes a jet pump each having inlet and outlet diffusers and a constrictions therebetween, said outlet diffuser of said jet pump of said liquid supplying pump means communicating with said inlet part of said lowermost liquid accumulating portion, said communicating portions of said uppermost pair of communicating portions communicating with said construction of said jet pump of said liquid withdrawing pump means.

10. A device as defined in claim 7, wherein said pipe has upper and lower end section, said liquid supplying pump means including a jet pump which communicates said lower end section of said pipe with a source of liquid and is open to wind so that under the action of wind passing through said jet pump a liquid is supplied from the source into said lower end section of said pipe.

11. A device as defined in claim 7, wherein said pipe has upper and lower end sections, said liquid withdrawing pump means including a jet pump which is open to wind so that under the action of wind passing through said jet pump a liquid is withdrawn from said upper end section of said pipe.

12. A device as defined in claim 7, wherein said pipe has upper and lower end sections, said liquid withdrawing pump means including a jet pump which communicates said upper end section with a source of the same liquid so that under the action of liquid passing through said jet pump the liquid which has passed through said pipe is withdrawn from said upper end section of said pipe.

13. A device as defined in claim 12, wherein said liquid supplying pump means is also formed as a jet pump which communicates a source of the liquid with said inlet end section of said pipe and is open to wind so under the action of wind passing through said jet pump of said liquid supplying pump means the liquid is supplied from the source into said lower end section of said pipe.

14. A pipe for elevating liquids, comprising a plurality of substantially horizontal liquid accumulating portions located vertically adjacent to one another;

a plurality of pair of substantially vertical communicating portions arranged so that each pair of said communicating portions communicate two adjacent ones of said liquid accumulating portions with one another, each of said liquid accumulating portions having an inlet part and an outlet part, said communicating portions being arranged so that each pair of said communicating portions communicate a lower one of said liquid accumulating portions with said inlet part of an immediately next upper one of said liquid communicating portions;

means for subdividing each of said liquid accumulating portions into said inlet part and said outlet part and including a partition provided in each of said liquid accumulating portions, said partition being arranged so as to allow communication between said inlet part and said outlet part under said partition and over said partition in each of said liquid accumulating portions;

a plurality of emptying members each located in a respective one of said liquid accumulating portions so that one communicating portion of each pair opens to said emptying member located in a respective one of said liquid accumulating portions an empties into the same;

means forming an air inlet, a liquid inlet and an outlet; and pump means for producing a pressure for elevating a liquid successively through said communicating portions and liquid accumulating portions.

* * * * *